US005407154A

United States Patent [19]

Wetzel et al.

[11] Patent Number: 5,407,154

[45] Date of Patent: Apr. 18, 1995

[54] HOT BEARING SIMULATOR

[75] Inventors: Donald C. Wetzel, Berea; Walter N. Arth, Jr., Washington Court House, both of Ohio

[73] Assignee: Meg Trans Corp, Brookyn Hts., Ohio

[21] Appl. No.: 98,641

[22] Filed: Jul. 28, 1993

[51] Int. Cl.[6] ..... B61K 9/04

[52] U.S. Cl. ..... 246/169 A; 105/451; 246/206

[58] Field of Search ..... 105/451 X; 246/169 R, 246/169 A, 201, 206

[56] References Cited

U.S. PATENT DOCUMENTS

| | | | |
|---|---|---|---|
| 240,623 | 4/1881 | Tilden | 105/197.05 X |
| 4,268,257 | 5/1981 | Villar | 246/169 R X |
| 4,878,437 | 11/1989 | Myers et al. | 246/169 A X |
| 4,974,797 | 12/1990 | Myers et al. | 246/169 A |
| 5,095,823 | 5/1992 | McKeown, Jr. | 105/198.2 |
| 5,299,504 | 4/1994 | Abele | 104/2 |

FOREIGN PATENT DOCUMENTS

| | | | |
|---|---|---|---|
| 967658 | 5/1975 | Canada | 246/169 A |
| 435680 | 3/1912 | France | 246/206 |

*Primary Examiner*—Robert J. Oberleitner
*Assistant Examiner*—S. Joseph Morano
*Attorney, Agent, or Firm*—Rankin, Hill, Lewis & Clark

[57] ABSTRACT

Heaters are used to simulate wheel bearings at specified temperatures. Two heaters are mounted on each side of a railroad test car. The heaters are mounted on the sprung carriage of the car to reduce vibration of the hardware and avoid interfering with wheel trucks on the car. Ambient temperature sensors are similarly mounted. Wire brushes are mounted below the heaters and sensors to activate magnetic wheel flange sensors. The heaters are controlled by a system which is integrated with a hot wheel simulator system.

15 Claims, 5 Drawing Sheets

HOT BEARING SIMULATOR

BACKGROUND ON THE INVENTION

1. Field of the Invention

The present invention is generally directed to the field of railroad rolling stock hot bearing detection and, in particular, to an improved system for insuring that hot bearing detectors are operating properly.

2. Description of the Related Art

Defective wheel bearings on railroad equipment are a particularly important problem. When the maximum operating temperature of a railroad wheel bearing is exceeded, the wheel may fail, thus causing a derailment. Derailments, in addition to being hazardous to crews and passengers, may also lead to the contamination of the environment due to the spilling of hazardous materials and the like. In order to eliminate and minimize derailments, railroads typically employ "hot bearing detectors".

Hot bearing detectors, also known as "hot box detectors," are commonly used on railroads. The detectors include heat sensing scanners which are located at designated points along railroad tracks. The scanners sense the temperature of bearings on passing railroad rolling stock and, typically, transmit the sensed temperature information to a telemetry unit. At the telemetry unit, the sensed bearing temperature is compared against a reference and, if the reference temperature is exceeded, an alarm is transmitted via the telemetry unit to the locomotive engineer or a control tower.

The detectors are usually optical pyrometers aimed at the wheel bearings to detect excessive heat. A detector is typically aimed vertically at an angle with respect to the ground, so that it measures the thermal radiation from a bearing on the near side of the car. The thermal radiation measured is converted to a temperature reading.

Frequently, the detectors are activated by magnetic sensing transducers mounted near the rail which are triggered by the metal of the passing wheel flange. The magnetic sensors can be located near the detector location to activate the detector as each wheel passes, or the sensors can be located to activate the detector for the entire duration of a train and deactivate the detector after the train has passed. Detectors can be located on either side of a track.

When a hot box detector signals an over-heated wheel bearing, the locomotive engineer is expected to stop the train and determine whether the bearing is indeed over-heated. The stoppage of railroad traffic for this reason results in downtime for both freight and passengers. Accordingly, it is important that train stoppages for defective wheel bearings take place only when a defective wheel bearing condition has actually occurred. Conversely, it is important that all hot box detectors along a railroads' trackage be operating properly. Defectively operating hot box detectors may permit trains having defective wheel bearings to proceed uninterrupted thus causing derailments and corresponding injuries and property damage.

Verification and maintenance of hot box detectors is typically carried out by railroad employees who travel along the track periodically and who stop to verify hot box detectors along the route. Such maintenance and calibration procedures are labor intensive and expensive. More importantly, however, maintenance personnel are able to check hot box detectors only under static conditions. Hot box detectors may appear to be operating properly under static conditions but may, in fact, fail to detect hot wheel bearings under the dynamic conditions created by passing trains.

Hot box detectors typically fall into two classes, namely rail-mount and ballast-mount types. Rail-mounted hot box detectors are mounted on the ties directly next to the rail of a railroad track. Ballast mounted hot box detectors are located in the ballast adjacent the rail. The accuracy of both types may be affected by the passage of a train along the rail. For this reason, dynamic testing of hot box detectors is desirable.

It is desirable to provide an apparatus for maintaining and verifying hot box detectors which monitors the operation of such detectors under dynamic conditions caused by the passage of a load along the railroad track.

U.S. Pat. Nos. 4,878,437 and 4,974,797, both to Myers et al., show dynamic hot bearing simulators. The Myers et al. simulators include two heaters near each of several bearings. The heaters simulate bearings having specified temperatures above ambient to verify operation of hot box detectors. Because the heaters are mounted near the wheels, they must be mounted on the trucks to avoid interfering with relative movement of the carriage and trucks. In practice, mounting hardware has loosened or failed due to vibration of the trucks. In addition, such systems require a heater on each side of a bearing so that a leading detector senses one heater and a trailing detector senses the other. Because the location of the heaters interferes with detection of a hot box on the car equipped with the simulators, the car must be equipped with an on-board hot box detector safety system such as temperature transducers mounted on the bearing housing.

SUMMARY OF THE INVENTION

The invention comprehends an apparatus for simulating a hot bearing on railroad rolling stock to verify the operation of a hot bearing detector. The apparatus includes a movable carriage and a truck. A resilient means of support is disposed on the truck to support the carriage. At least one heater is disposed on the carriage to simulate a hot bearing.

In accordance with the preferred embodiments of the present invention, a first heater for simulating a bearing which is not hot and a second heater for simulating a bearing which is hot are mounted on the sprung carriage. Similar pairs of these first and second heaters are mounted on opposite sides of the axle for verifying the proper operation of rail-mounted hot box detectors regardless of which direction the carriage is traveling with respect to the detectors. The heaters should be mounted at a height which corresponds with the intersection of two beams from two hot bearing detectors aimed in opposite directions. Thus, separate leading and trailing heaters are not required.

Mounting the heaters on the sprung carriage reduces the vibration of the heaters and mounting hardware to reduce mechanical failures. Mounting on the carriage also permits the heaters to be located so that they do not interfere with detection of the actual bearings on the car. The heaters are mounted higher than on prior systems and are more easily accessed.

The present invention contemplates the provision of heaters for simulating hot bearings which may be sensed by both rail-mounted and ballast-mounted hot box detectors. Moreover, heaters are provided for simulating a hot bearing regardless of whether the carriage is traveling in the leading or trailing direction so far as the line of sight of the hot box detectors is concerned. Also associated with the carriage are ambient temperature sensors preferably mounted on the carriage in a similar manner to the heaters. Means are provided for controlling the temperature of each of the heaters to maintain a predetermined temperature above ambient. Each of the heaters can be controlled separately so that one is set above a reference temperature representing a hot bearing and another is below that temperature. Utilizing the device of the present invention thus far described, hot box detectors may be verified to insure that such detectors respond when the absolute temperature above ambient exceeds a reference quantity which represents a hot bearing. Further, a predetermined temperature differential can be maintained between heaters on opposite sides of the carriage. Using this approach hot box detectors may be verified to insure that the hot box detector trips when the differential temperature between a right wheel bearing is a second predetermined temperature above the left wheel bearing and vice versa.

It has been found that when a differential temperature of a left wheel bearing with respect to a right wheel bearing or vice versa exceeds a predetermined amount that such wheel bearing is likely to fail even if the absolute temperature of that wheel bearing is not excessive. Thus the present invention is able to verify the operation of hot box detectors to insure that the detectors trip when either the right or left bearings exceed ambient by a first predetermined amount or whenever the temperature of the left or right bearing differs from the other by a second predetermined amount.

A mass, such as a heavy wire brush or metal block, is disposed below each of the heaters and ambient temperature sensors to activate the hot box detector.

DETAILED DESCRIPTION OF THE PREFERRED EMBODIMENTS

Figure 1:
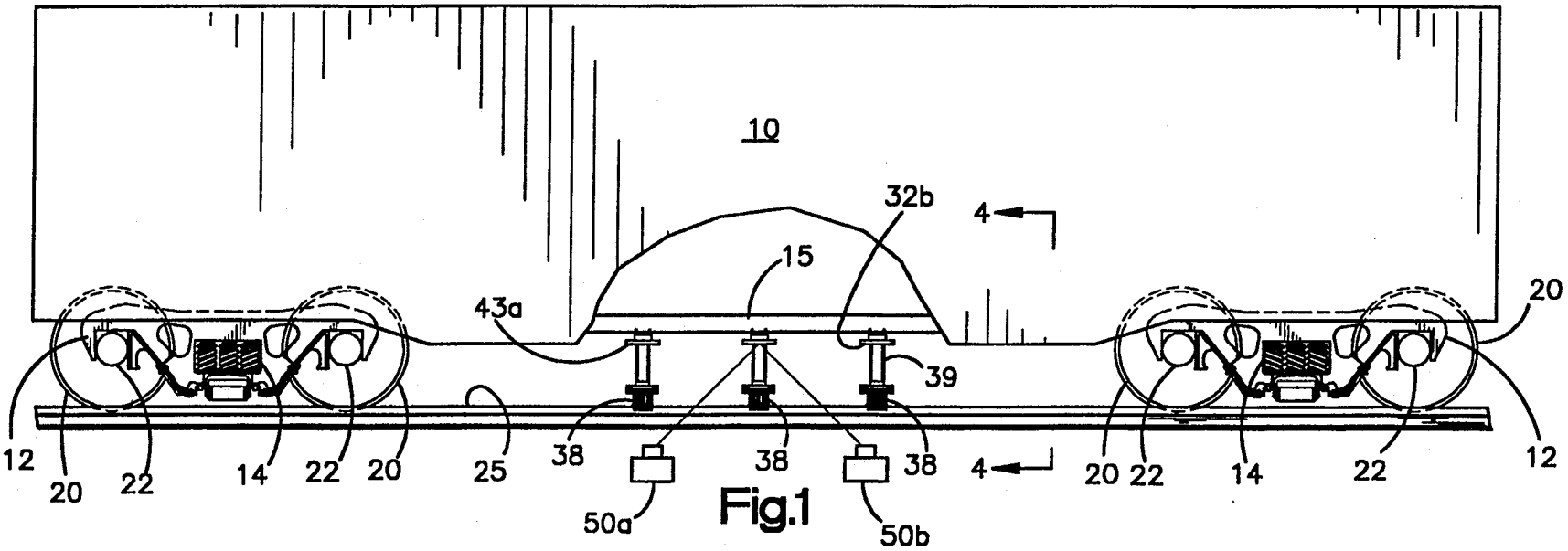
FIG. 1 is a side elevational view of a railroad car equipped with the present invention.

As shown in FIG. 1, a movable carriage, preferably railroad rolling stock such as a test car 10 has at least two trucks 12 journalled thereon. The car usually has a second truck 12 which is substantially identical to the first truck 12. The car 10 rides on resilient means, such as truck springs 14, disposed on the truck 12 to resiliently support the carriage. The carriage includes a rigid frame including two I-beams 15 running parallel to each other along the sides of the carriage and being supported by the springs 14.

Figure 2:
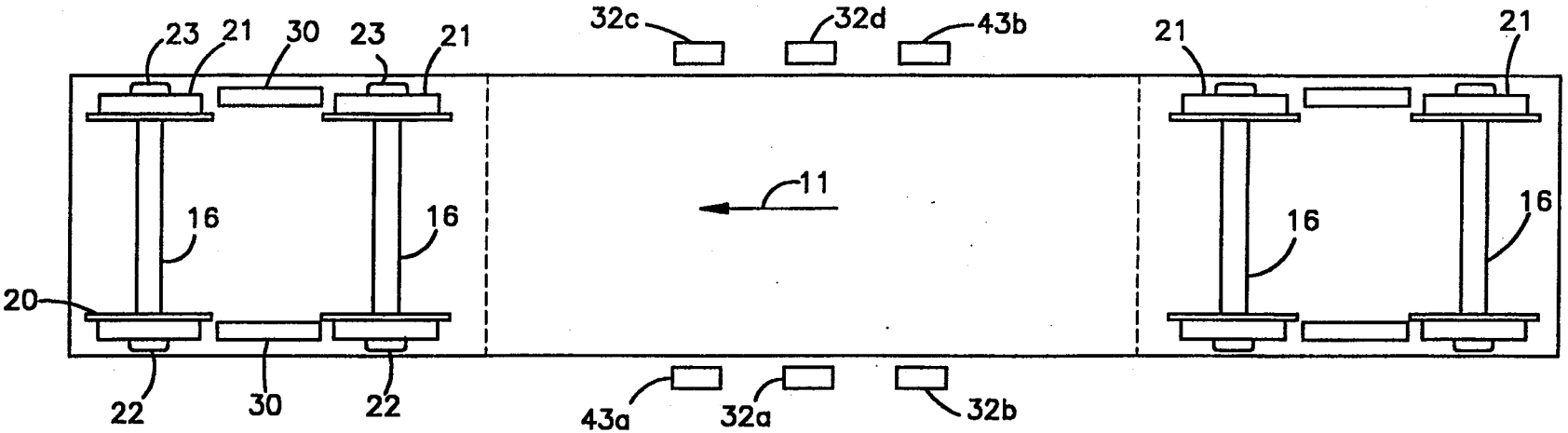
FIG. 2 is a top schematic plan view of a railroad car equipped with the present invention.
Figure 3:
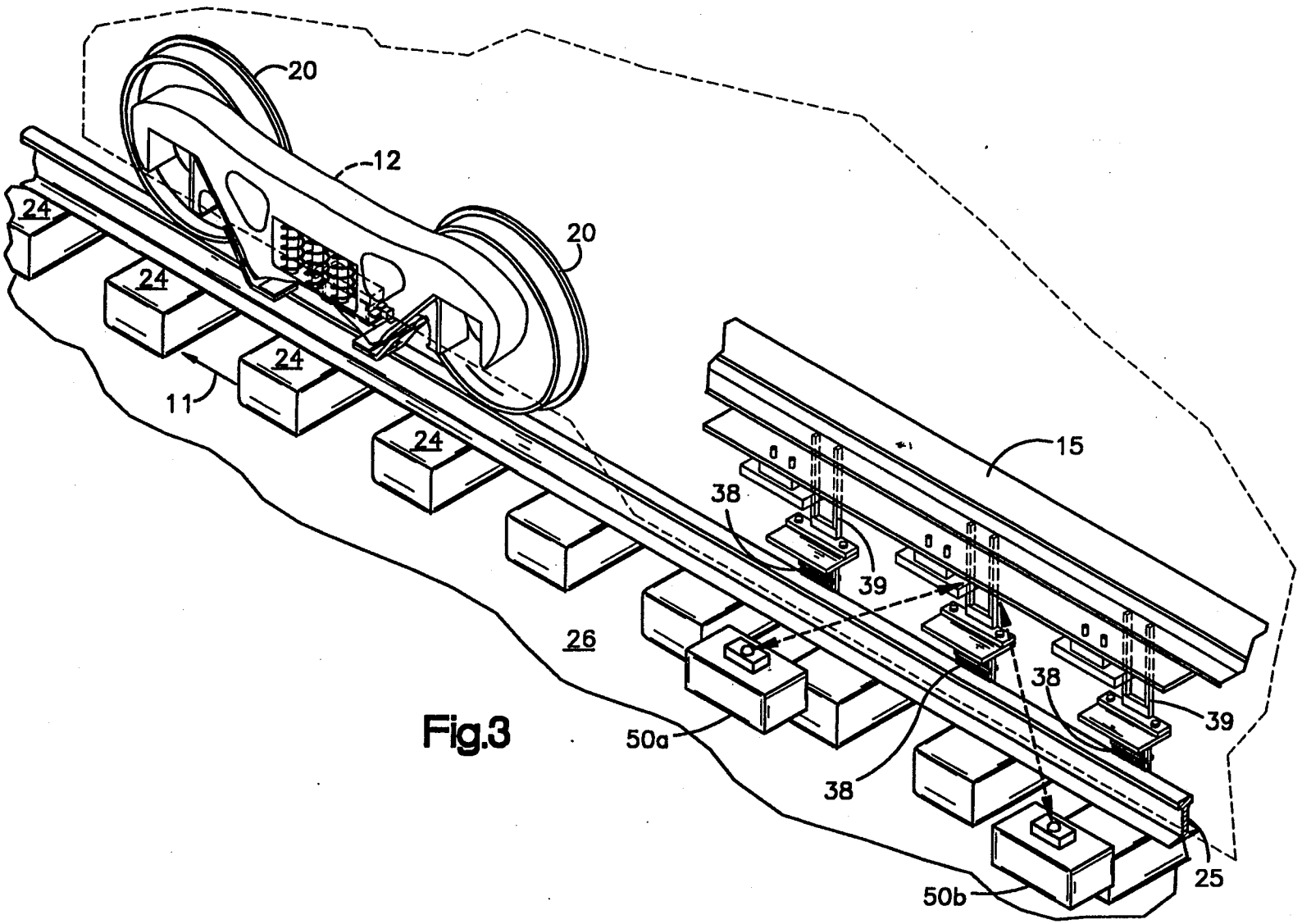
FIG. 3 is a perspective view of a portion of the railroad car on a track.

As shown in FIG. 2, each truck has at least two parallel axles 16. Each axle has a left end with a left wheel 20 journalled thereon by means of a bearing in a bearing housing 22. Each axle also has a right end with a right wheel 21 journalled thereon by means of a bearing in a bearing housing 23. During travel, the wheels 20 and 21 roll on rails 25 mounted on ties 24 resting on a roadbed 26, as shown in FIG. 3. The car 10 has what is known as a "B" end which can be identified by the location of a hand-operated brake wheel (not shown). For the purposes of discussion, the car 10 is presumed to travel in the direction denoted by arrow 11. However, the car can operate in either direction.

A hot wheel simulator 30 can be disposed between the left wheels 20 on the truck 12 substantially within the profile formed by the thickness of the wheels. The hot wheel simulator 30 is of a type which can direct heat in a selected direction and is positioned so that it directs heat outwardly from the car 10. A hot wheel simulator system is described in U.S. patent application Ser. No. 07/984,539, owned by the assignee hereof, which is incorporated herein by reference.

Figure 4:
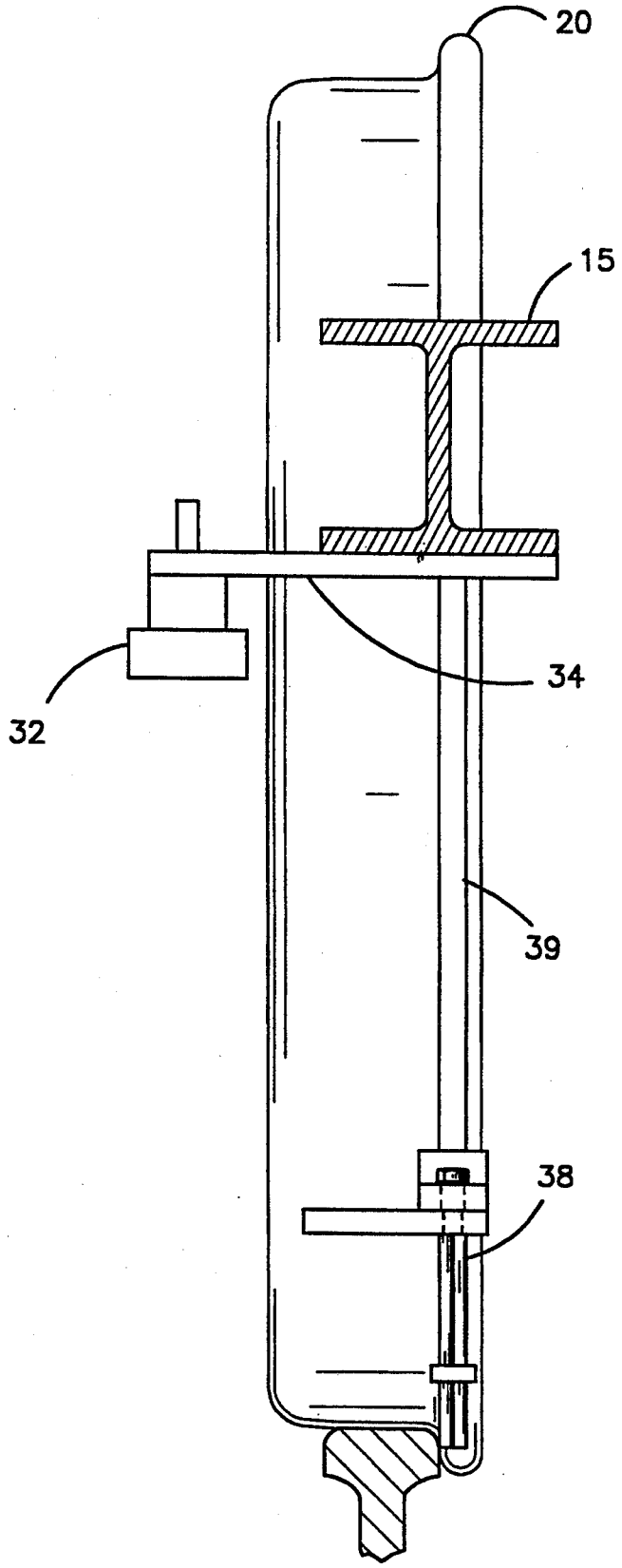
FIG. 4 is a sectional view of a detail of FIG. 1 taken from 4—4.

As shown in FIGS. 1 and 4, a heater 32 is mounted to the sprung carriage 10 by a bracket 34. Preferably, the bracket 34 is mounted on the I-beam 15. The heater 32 is located outboard of the wheels 20 and at approximately the same height as the wheel bearing housings 22. Preferably, four heaters **32*a*–32*d* are located on the car, two on each side, as shown in FIG. 2. An ambient temperature sensor 43 is mounted similarly to the heater and is located forward or aft of the heater 32**.

Figure 5:
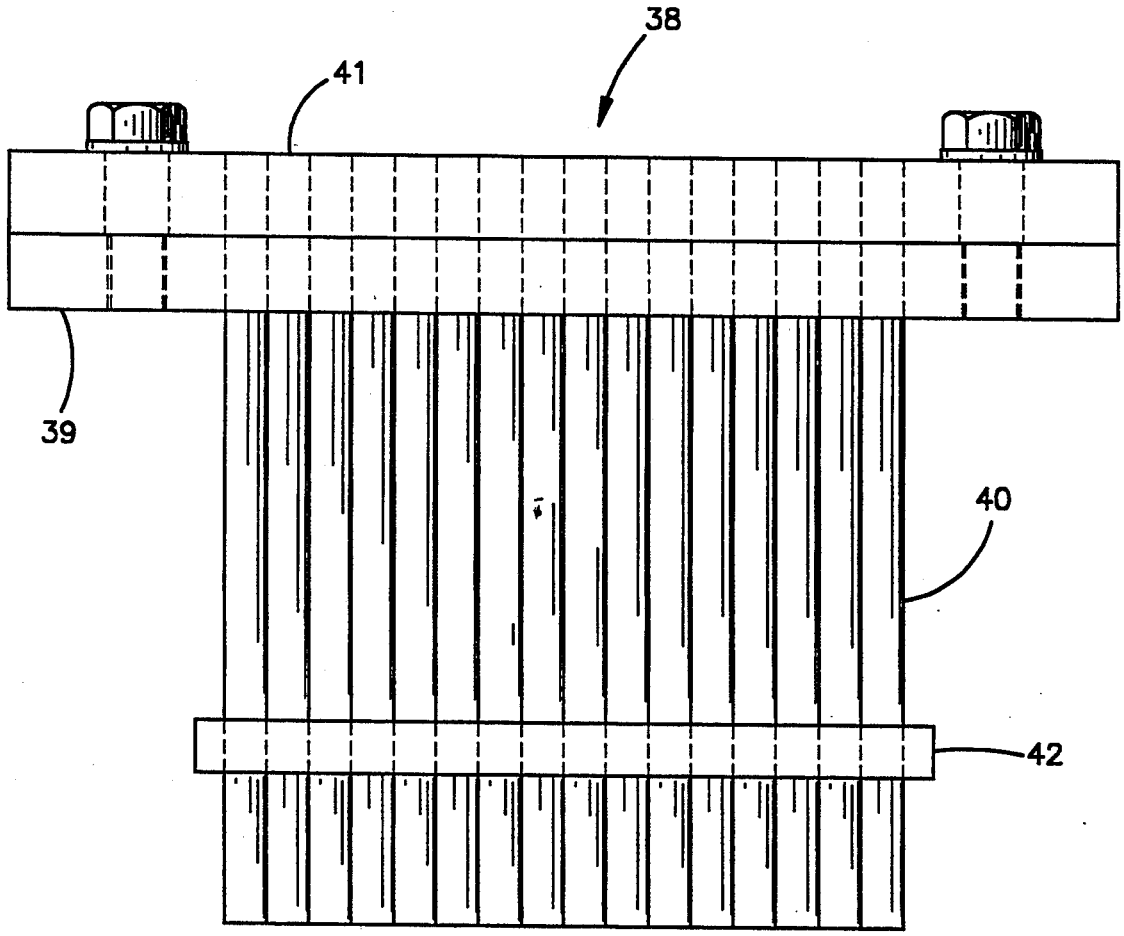
FIG. 5 is a detail elevational view of an activator according to the invention.
Figure 6:
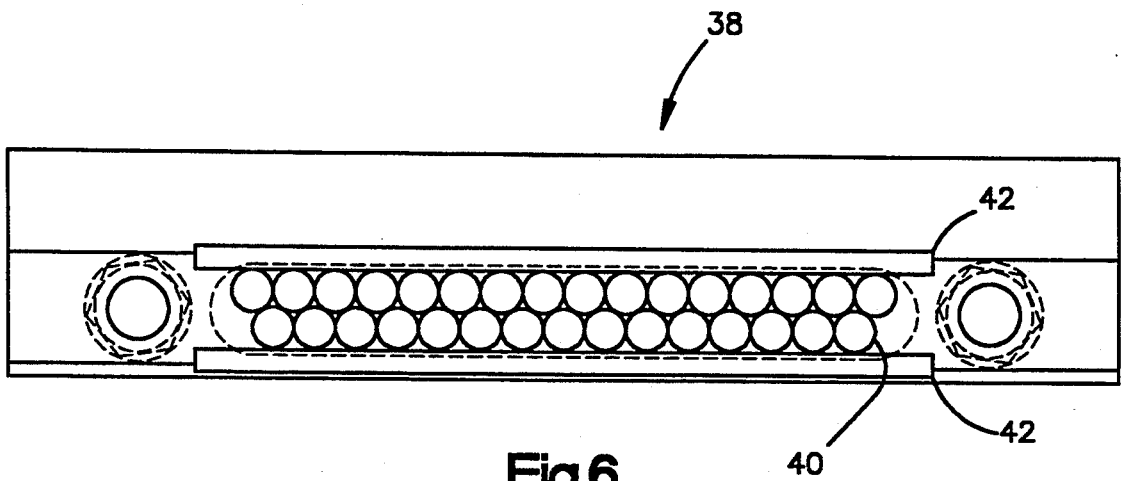
FIG. 6 is a detail bottom view of an activator according to the invention.

A detector activator 38 is mounted on the carriage preferably by a bracket 39 attached to the I-beam 15. As shown in FIGS. 5 and 6, the detector activator preferably is a wire brush which is located immediately adjacent to or in contact with an inner edge of the rail 25. The wire brush 38 includes a plurality of vertically extending stranded wire cables 40. The cables 40 should be made from a ferrous material and are mounted on the bracket 39 by means of tack welds 41 or a clamp, for example. A means to hold the cables together in a compacted and generally vertical position can be provided. The holding means shown includes two rigid bars 42 welded to the cables near the ends of the bars. The brush 38 generally maintains its shape, but is sufficiently flexible to yield to obstructions and unevenness in the railway. The detector activator may be a solid ferromagnetic block rather than a brush. The activator should have sufficient mass to simulate a wheel flange and trigger a magnetic detector of a type known in the art.

A hot bearing detector 50, of a type known in the art, is located on the roadbed 26 near the rail 25. The detector 50 is positioned to scan substantially vertically at approximately a 45° angle, as shown in FIGS. 1 and 3. A leading detector **50*a* has its beam directed at an angle toward the front of a car moving in the direction of travel 11. A trailing detector 50*b*** is located so that its beam is directed at an angle toward the rear of the car or toward a car moving in the opposite direction.

In operation, the heaters **32*a*–32*d* are controlled by known means to generate thermal radiation directed vertically downwardly from the car 10. The thermal radiation is controlled to simulate a bearing at a specified temperature above ambient so that, when the heater is within the field being scanned by the detector 50**, the detector will sense a bearing having the specified temperature.

In some installations, the hot wheel detectors 50 are turned on and off by magnetic sensing transducers. The transducer senses a mass of metal, such as a wheel flange. The transducer may be located adjacent the detector to turn the detector on and off for each wheel or axle, or the transducer may be located some distance from the detector to turn the detector on for the duration of passing of an entire train. The activator 38 activates either type of magnetically activated detector 50.

Figure 7:
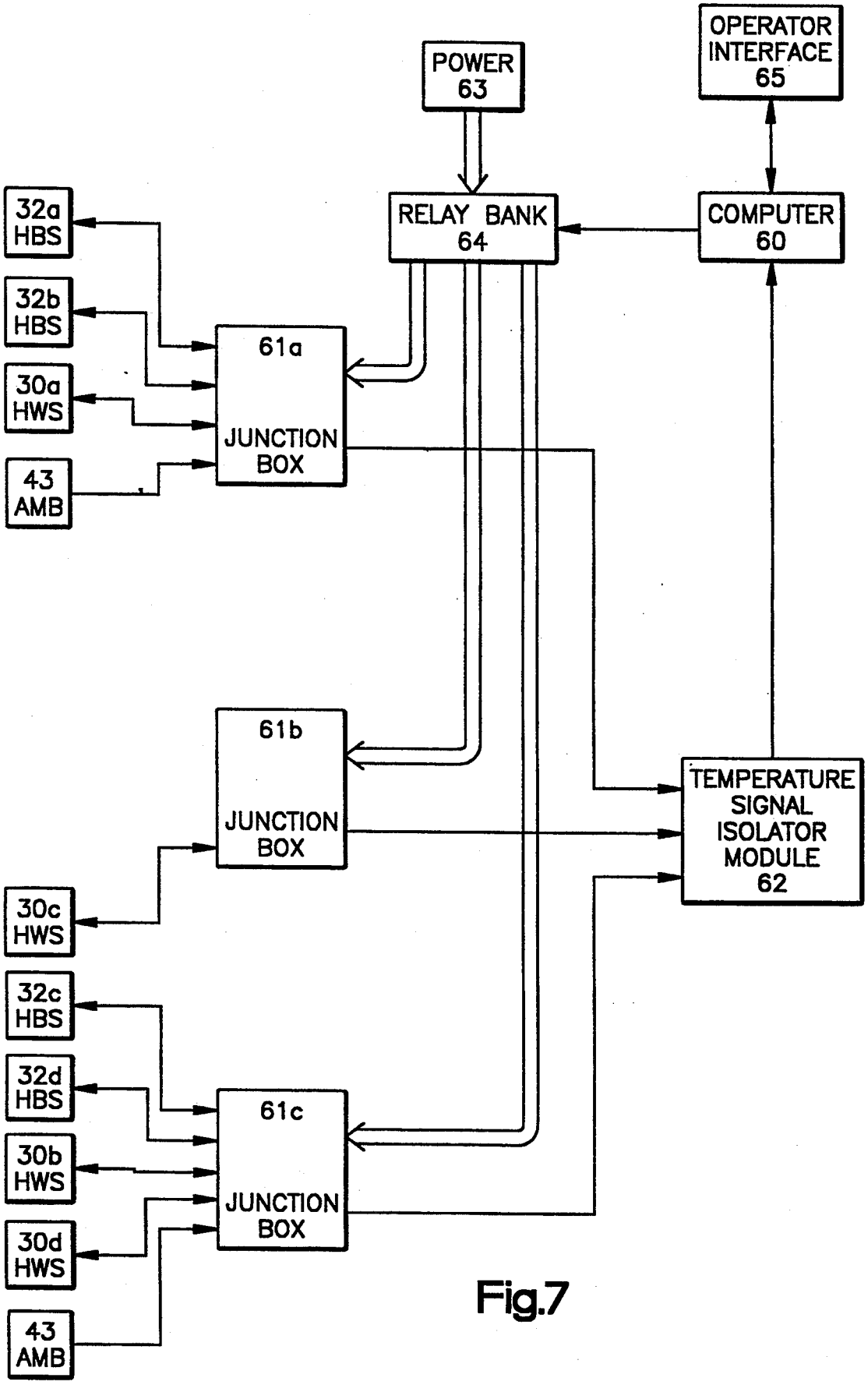
FIG. 7 is a schematic diagram of a control system according to the invention.

Referring to FIG. 7, the ambient sensor 43 provides ambient temperature information to a computer 60 by connections through a junction box 61 and a temperature signal isolation module 62. The computer includes an operator interface 65 such as a display, keyboard and printer so that an operator can input information such as operating parameters and can receive system information. Each heater 32 includes a temperature sensor, such as a thermocouple, which provides feedback information of the temperature of the heater to the computer 60 by connections through a wheel truck junction box 61 and the temperature signal isolation module 62.

Electrical power 63 is supplied to the heaters through a relay bank 64 and a junction box 61. The computer controls the temperature of the heaters 32 in response to the temperature information from the ambient sensors 43 and the thermo-couples to maintain a specified temperature above ambient as discussed below. The temperature of the heaters 32 is controlled by varying the duty cycle of the power supplied to the heater by switching a relay in the relay bank 64. Alternatively, the magnitude of the voltage supplied to the heater 32 can be varied to control the heater temperature.

The temperature of the hot wheel simulators 30 is controlled by the computer 60 in a similar manner to the control of the hot bearing simulator heaters 32 by using temperature information from the same ambient temperature sensors 43.

In a preferred embodiment, four heaters **32*a*–32*d* and two ambient sensors 43*a* and 43*b* are used. They are arranged as shown in FIG. 2. The forward left side heater 32*a* is maintained at a temperature above ambient which is lower than a reference temperature which indicates a hot bearing. The aft left side heater 32*b* is maintained at a temperature above ambient which is higher than a reference temperature which indicates a hot bearing. A typical reference temperature which represents a hot bearing is 200° F. above ambient. Similarly, the right side heaters 32*c* and 32*d* are maintained at high and low temperatures. Simultaneously or alternatively, heaters on opposite sides, 32*a* and 32*d*, for example, can be maintained at a significant temperature differential, for example, 140° F. The heater 32*b* opposite the ambient sensor 43*b*** can also be used to maintain a temperature differential between the opposite sides of the car.

If a hot bearing is detected when the low temperature heater **32*a* passes the detector, the detector is probably miscalibrated or defective. If a hot bearing is not detected when the high temperature heater 32*b*** passes the detector, it might mean that the detector was not activated, is inoperative, misaligned, miscalibrated or otherwise defective and needs attention. A defective bearing condition should also be indicated when the temperature differential on opposite sides exceeds a predetermined quantity. In this manner, the hot bearing simulator can verify the proper operation of a hot bearing detector.

Since a test car is likely to have both a hot bearing simulator and a hot wheel simulator installed, the controls should be integrated so that they can cooperate by using the same ambient sensors and computer as described above. Also, the hot wheel detector and the hot bearing detector may be in close proximity; thus, the present invention helps prevent interference between hot wheel and hot bearing simulators.

The present disclosure describes several embodiments of the invention, however, the invention is not limited to these embodiments. Other variations are contemplated to be within the spirit and scope of the invention and appended claims.

What is claimed is:

1. An apparatus for simulating a hot bearing on railroad rolling stock to verity the operation of a hot bearing detector, comprising:

a carriage;

a truck having wheels and bearings;

resilient means for supporting the carriage on the truck, whereby the carriage is movable relative to the truck;

at least one heater mounted on the carriage and movable with the carriage relative to the truck, the heater simulating a hot wheel bearing; and means for activating a hot bearing detector, the activating means being separate from the wheels and disposed adjacent to the heater.

2. An apparatus according to claim 1, further comprising means for controlling the temperature of the heater to a specified temperature above ambient.

3. An apparatus according to claim 1, further comprising a second truck spaced from the first, and resilient means for supporting the carriage on the second truck, the heater spaced from the trucks and located between the trucks.

4. An apparatus according to claim 1, wherein the heater is located at a height coinciding with a height of an intersection of two detection beams of a hot bearing detector.

5. An apparatus according to claim 1, wherein the heater is located outside of the path of a beam of a hot bearing detector which is directed at a bearing.

6. An apparatus according to claim 1, wherein the activating means comprises a ferromagnetic mass.

7. An apparatus according to claim 1, wherein the truck includes at least one substantially horizontal axle having a wheel at each end; and the heater is positioned at substantially the same height as the axle.

8. An apparatus according to claim 1, further comprising a means to control the temperature of the heater to a specified temperature above ambient.

9. An apparatus according to claim 8, further comprising an ambient temperature sensor operatively connected to the controller.

10. An apparatus for simulating a hot bearing on railroad rolling stock to verify the operation of a hot bearing detector, comprising:

a movable carriages;

a truck;

resilient means for supporting the carriage disposed on the truck;

at least one heater disposed on the carriage to simulate a hot bearing; and means for activating a hot bearing detector disposed adjacent the heater, the activating means comprising a wire brush.

11. An apparatus according to claim 10, wherein the brush comprises a plurality of vertically extending stranded wire cables and a means to hold the cables in a compacted, substantially vertical position.

12. An apparatus according to claim 10, wherein the wire brush contacts a rail on which the rolling stock is riding.

13. An apparatus for simulating a hot bearing on railroad rolling stock to verify the operation of a hot bearing detector, comprising:

a carriage:

a truck having wheels and bearings;

resilient means for supporting the carriage on the truck, whereby the carriage is movable relative to the truck; and at least one heater mounted on the carriage and movable with the carriage relative to the truck, the heater simulating a hot wheel bearing, one heater being maintained at a temperature above ambient which exceeds a reference temperature, and a second heater being maintained at a temperature above ambient which is below the reference temperature.

14. An apparatus for simulating a hot bearing on railroad rolling stock to verify the operation of a hot bearing detector, comprising:

a carriage;

a pair of trucks each having at least one substantially horizontal axle;

a wheel mounted with bearings at each end of each axle for riding on a rail;

spring means on each truck to support the carriage on the truck, whereby the carriage is movable relative to the truck;

two heaters mounted on the left side of the carriage at substantially the same height as the axle, the heaters being movable with the carriage relative to the truck, each of the heaters simulating a wheel bearing at a specific temperature;

an ambient temperature sensor disposed on the left side of the carriage between the trucks at substantially the same height as the axle;

means for controlling one of the heaters to a temperature above ambient which exceeds the temperature of a hot bearing and the other of the heaters to a temperature above ambient which is below the temperature of a hot wheel bearing; and means for activating a hot bearing detector and disposed below each heater and the ambient sensor.

15. An apparatus for simulating a hot bearing on railroad rolling stock to verify the operation of a hot bearing detector, comprising:

a movable carriage having left and right sides; two trucks, each having two substantially horizontal axles;

a wheel at each end of each axle for riding on a rail;

spring means disposed on each truck to support the carriage;

two heaters disposed on the left side of the carriage between the trucks at substantially the same height as the axle, each simulating a bearing at a specific temperature;

an ambient temperature sensor disposed on the left side of the carriage between the trucks at substantially the same height as the axle;

two heaters disposed on the right side of the carriage between the trucks at substantially the same height as the axle, each simulating a bearing at a specific temperature;

a means to control one of the heaters on each side to a temperature above ambient which exceeds the temperature of a hot bearing;

a means to control the other heaters on each side to a temperature above ambient which is below the temperature of a hot bearing;

an ambient temperature sensor disposed on the right side of the carriage between the trucks at substantially the same height as the axle and operatively connected to the heater controllers; and a means to activate a hot bearing detector and disposed below each heater and each ambient sensor, said activator comprising a wire brush which contacts the rail.

* * * * *

UNITED STATES PATENT AND TRADEMARK OFFICE

CERTIFICATE OF CORRECTION

PATENT NO. : 5,407,154

DATED : April 18, 1995

INVENTOR(S) : Donald C. Wetzel et al.

It is certified that error appears in the above-indentified patent and that said Letters Patent is hereby corrected as shown below:

Col. 6, line 13 "verity" should be --verify--
Col. 6, line 58 "carriages" should be --carriage--
Col. 7, line 9 ":" should be --;--
Col. 8, line 11 after "side;" start a new line Signed and Sealed this Twenty-fifth Day of July, 1995

Bruce Lehman

*Attest:*

BRUCE LEHMAN

*Attesting Officer*

*Commissioner of Patents and Trademarks*